United States Patent [19]

Kabik et al.

[11] 4,394,197

[45] Jul. 19, 1983

[54] COOK-OFF RESISTANT BOOSTER EXPLOSIVE

[75] Inventors: Irving Kabik, Silver Spring; Vernon D. Ringbloom, West Friendship, both of Md.

[73] Assignee: The United States of America as represented by the Secretary of the Navy, Washington, D.C.

[21] Appl. No.: 265,133

[22] Filed: May 19, 1981

[51] Int. Cl.[3] ..... C06B 45/10

[52] U.S. Cl. ..... 149/19.3; 149/92

[58] Field of Search ..... 149/19.3, 92

[56] References Cited

U.S. PATENT DOCUMENTS

| | | | |
|---|---|---|---|
| 3,296,041 | 1/1967 | Wright | 149/19.3 |
| 3,326,731 | 6/1967 | Noddin | 149/19.3 |
| 3,455,749 | 7/1969 | Gow | 149/19.3 |
| 3,985,595 | 10/1976 | Benzinger | 149/19.3 |
| 4,042,430 | 8/1977 | Falterman et al. | 149/19.3 |
| 4,047,990 | 9/1977 | Falterman | 149/19.2 |

*Primary Examiner*—Edward A. Miller

*Attorney, Agent, or Firm*—R. S. Sciascia; A. L. Branning; R. D. Johnson

[57] ABSTRACT

A cook-off resistant booster explosive comprising a mixture of 1,3,5-triamino-2,4,6-trinitrobenzene, with a second explosive selected from the group consisting of cyclotrimethylenetrinitramine (RDX), cyclotetramethylenetetranitramine (HMX), and mixtures thereof, and a compatible binder.

4 Claims, 1 Drawing Figure

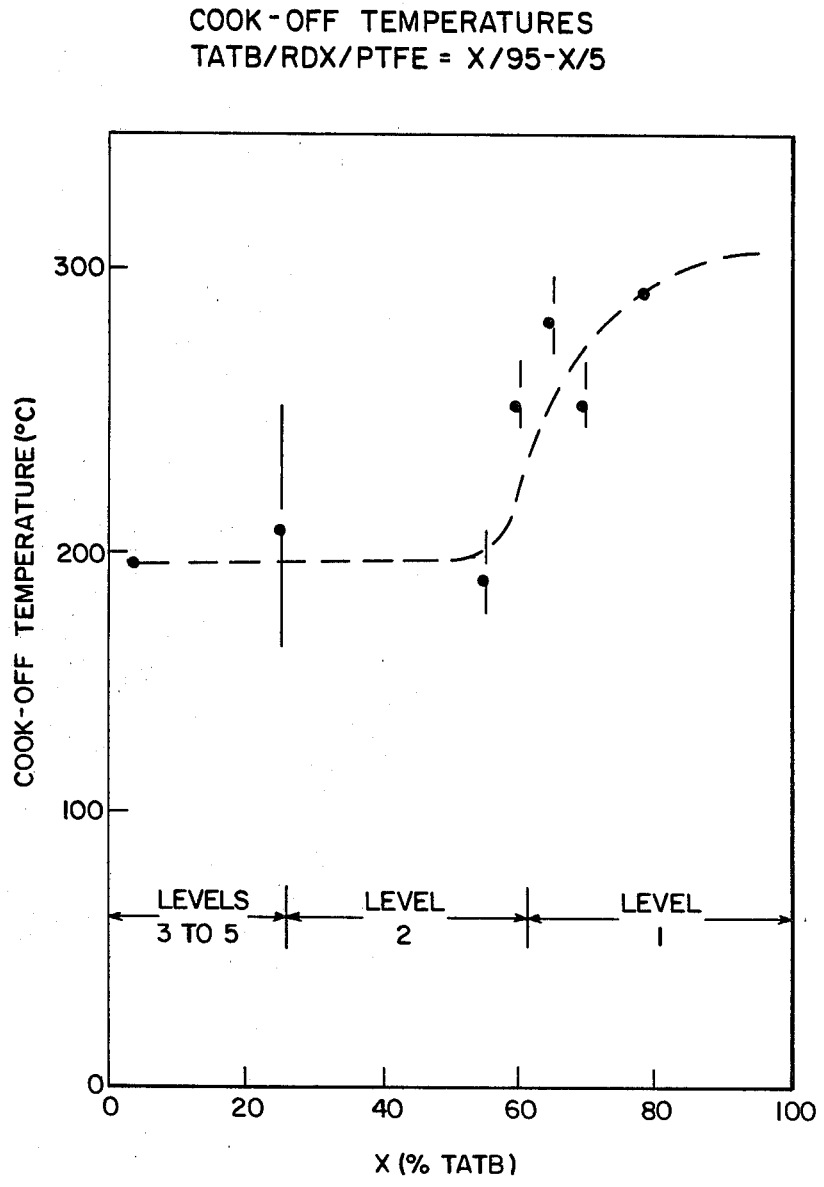
COOK-OFF TEMPERATURES
TATB/RDX/PTFE = X/95-X/5
COOK-OFF TEMPERATURE (°C)
300
200
100
0
LEVELS 3 TO 5
LEVEL 2
LEVEL 1
0
20
40
60
80
100
X (% TATB)

COOK-OFF RESISTANT BOOSTER EXPLOSIVE

BACKGROUND OF THE INVENTION

This invention relates to explosives and more particularly to booster explosives.

Since the occurrence of the catastrophic fires aboard the USS FORRESTAL and USS ENTERPRISE, there has been a considerable effort within the U.S. Navy to introduce cook-off resistant ordnance into the fleet. In response to these fires, cook-off improvement programs have been instituted within the Navy with the goal of eventually developing weapons that neither detonate nor explode when subjected to fuel fires. Significant improvements have been made in increasing the cook-off times of ordnance through the use of heat path interruption techniques such as the use of internal insulating liners and external intumescent coatings. These approaches are designed to prevent or slow down the flow of heat for the explosives contained in the warhead. But, if the ordnance item is heated for a sufficiently long time, most, if not all, of these approaches could be defeated. Thus, for the warhead, the ultimate goal of developing weapons that neither detonate nor explode in a fuel fire will be very difficult to obtain unless cook-off resistant explosives are also incorporated into the weapon.

A number of main charge explosives have been developed which possess cook-off characteristics which indicate that they cook-off mildly in fuel fires. Unfortunately, the use of a cook-off resistant main charge will not itself insure a cook-off resistant warhead since the main charge can still be detonated by a cook-off sensitive booster. It is therefore critical that a cook-off resistant booster explosive be developed.

SUMMARY OF THE INVENTION

Accordingly, an object of this invention is to provide a novel explosive.

Another object of this invention is to provide a cook-off resistant booster explosive.

Yet another object of this invention is to provide a booster explosive which will not detonate in fuel fires.

These and other objects of this invention are accomplished by providing an explosive composite comprising:

A. a mixture of explosives comprising (1) from 30 to 75 weight percent of 1,3,5-triamino-2,4,6-trinitrobenezene, and (2) the remainder being a second explosive selected from the group consisting of cyclotetramethylenetetranitramine, cyclotrimethylenetrinitramine, and mixtures thereof; and B. a compatible binder.

BRIEF DESCRIPTION OF THE DRAWING

The FIGURE presents fast cook-off test results for a number of composites containing 1,3,5-triamino-2,4,6-trinitrobenzene (TATB), cyclotrimethylenetrinitramine (RDX), and polytetrafluoroethylene (PTFE; Dupont's Teflon 7C TM) as a binder. These results and their significance are more fully discussed in Example 2.

DESCRIPTION OF THE PREFERRED EMBODIMENT

The explosive composition of the present invention is a physical mixture of small particles of 1,3,5-triamino-2,4,6-trinitrobenezene (hereafter referred to as TATB) and cyclotrimethylenetrinitramine (RDX), cyclotetramethylenetetranitramine (HMX), or mixtures thereof along with a compatible propellant binder. From about 30 to about 75 weight percent of TATB with the remainder (70 to 25 weight percent) being RDX, HMX, or mixtures thereof is used. If too much TATB is used the explosive composition will be too insensitive to be used as a booster explosive. The explosive composition preferably should be capable of being detonated by a No. 8 detonating cap. On the other hand, if the composition is too rich in RDX or HMX, it will have poor cook-off properties and will be likely to detonate when confined in a fuel fire. Preferably from 50 to 65 and more preferable from 58 to 62 weight percent of TATB is used, with RDX, HMX, or mixtures thereof constituting the remainder of the explosive mixtures.

Conventional TATB, RDX, and HMX in the form of small particles and meeting standard U.S. Government and Military specifications are suitable for use in this invention.

The binder used is a polymeric material which is compatible (will not react) with the TATB, RDX, and HMX. Preferably the polymer should have a glass transition temperature (Tg) greater than 105° C. This is because TATB has been reported to undergo irreversible growth when temperature cycled between −59° C. and +104° C. By using a polymer having a Tg above this range, irreversible growth in the explosive composite can be minimized. The preferred polymer is polytetrafluoroethylene which is compatible with TATB, RDX, and HMX and which has a Tg reported to be greater than 125° C. Military specification MIL-P-48296 (PA) dated 1 May 1974 details the desired properties of this material. A suitable form of polytetrafluoroethylene is available under the Trademark Teflon 7C TM from E. I. duPont de Nemours and Co., Inc., Wilmington, Del., 19898.

The amount of binder used is not critical. However, enough binder must be used to provide a good explosive composite structure. On the other hand, using more than is necessary will reduce the performance of the explosive composition unnecessarily. From 4 to 6 weight percent of polytetrafluoroethylene based on the total weight of the explosive composite is preferred. In particular, good composites were achieved by using about 5 weight percent of polytetrafluoroethylene.

A method of preparing the explosive composite is given in example 1. A slurry of the TATB, RDX (or HMX), and binder particles is formed in hexane (or a similar solvent) and vigorously agitated until all the lumps are broken up and the particles are throughly mixed. The hexane is then removed and the powdered explosive composition is dried.

The powdered explosive composite can be pressed into pellets or pressure loaded into casings by conventional techniques. The loading pressure may be from 1,000 to 75,000 psi, with from 10,000 to 27,000 psi being preferred and from 15,000 to 17,000 psi being more preferred. Table 1 illustrates the relationship between loading pressure and charge density and detonation velocity for a composite of 60 weight percent TATB, 35 weight percent of RDX, and 5 weight percent of Teflon 7C TM (polytetrafluoroethylene).

TABLE 1

| Loading Pressure (psi) | Ave. Charge Density (g/cm$^3$) | Ave. Detonation Velocity (m/sec) |
|---|---|---|
| 4,000 | 1.472 | 6872 |
| 16,000 | 1.747 | 7600 |
| 32,000 | 1.804 | 7669 |

The addition of barium stearate appears to greatly reduce the problem of the dusting and clinging of the explosive mixture during the filling of press dies. Therefore, the addition of from 1 to 2 weight percent of barium stearate to the explosive mixture is recommended if an automatic tabletting press is to be used.

The general nature of the invention having been set forth, the following example is presented as a specific illustration thereof. It will be understood that the invention is not limited to this specific example but is susceptible to various modifications that will be recognized by one of ordinary skill in the art.

EXAMPLE 1

9000 grams of 1,3,5-triamino-2,4,6-trinitrobenzene (TATB), 5250 grams of class "E" cyclotrimethylenetrinitramine (RDX), and 750 grams of Teflon 7C TM (polytetrafluoroethylene) were placed in a large (40 cm diameter × 5 cm high) kettle. Approximately 10 liters of hexane was then added with stirring to form a loose slurry. A cover was fitted to the kettle and vigorous agitation was provided by a Lightning Mixer Model C-2, turning at 1750 RPM with a 100 mm, 45° pitch propeller. The mass was agitated for 3 hours in order to insure that all lumps of material were broken up and blended. After allowing the blend to settle, the excess hexane was decanted off and the explosive mixture was allowed to dry at 70° C. for 24 hours.

EXAMPLE 2

Fast Cook-Off Test

Mixtures of 1,3,5-triamino-2,4,6-trinitrobenzene (TATB), cyclotrimethylenetrinitramine (RDX), and polytetrafluoroethylene (PTFE, Dupont Teflon 7C TM) were pressed into 25 mm diameter, 25 mm long right cylinders for use in cook-off testing. This work was directed at determining the maximum percentage of RDX that could be incorporated into a TATB/RDX/PTFE explosive composition and still have an explosive which would react mildly during thermal decomposition. This testing was of the fast cook-off type, utilizing a very simple cook-off test apparatus. It consisted of a fire pan filled with standard JP-5 jet fuel and a cook-off bomb containing the explosive to be studied. The bomb itself consisted of a standard 1½-inch long 1-inch diameter pipe nipple enclosed with two pipe caps. A thermocouple was inserted through one pipe cap and attached to the inner surface of the bomb. The bomb contained the explosive cylindrical charge, 25 mm in diameter and 25 mm long. The fuel was ignited and the resultant temperature rise was recorded. The cook-off temperature and the effect of the cook-off on the bomb was recorded. The cook-off temperatures reported here were those of bomb inner surface/explosive surface interface. A typical temperature rise versus time plot observed in these tests is shown in the figure. Temperature increases at the bomb inner surface were usually between 40° C. and 50° C./minute. Five distinct levels of severity in the cook-off reactions were observed during testing;

(1) reaction level 1, mild burn, little if any damage to the bomb;

(2) reaction level 2, mild pressure rupture, end cap was usually ruptured very mildly;

(3) reaction level 3, violent rupture, some large fragments were produced from the bomb;

(4) reaction level 4, partial detonation, greater number of fragments and of a smaller size are produced from the bomb; and (5) reaction level 5, high order detonation, likewise a greater number of fragments and of a smaller size are produced.

This cook-off test was applied to various mixtures of TATB, RDX (class E), and PTFE to determine the maximum percent of RDX that could be incorporated into the mixture and still retain relatively mild cook-off properties. The PTFE binder content was held constant at 5% by weight. The remaining 95% consisted of varying amounts of TATB and RDX. The results are presented in the FIGURE.

In the FIGURE is illustrated a curve of cook-off temperature versus percent TATB in the composition. Reaction levels are also depicted. For low levels of TATB (high levels of RDX), the compositions behave very similar to high RDX compositions, such as CH-6—they cooked-off at approximately 200° C. with severe reactions, usually low (reaction level 4) or high (reaction level 5) order detonations. At high TATB percentages, the compositions behaved like TATB—they cooked-off at temperatures at or above 300° C. and the reactions are very mild. With compositions containing as little as 60% TATB (or as much as 35% RDX), we still observed a reaction level 1—mild burning. In the middle region, between 30% and 60% TATB, we observed the relatively mild reaction level 2—mild pressure rupture. Any booster explosive exhibiting reaction levels 1 (mild burning) or 2 (mild pressure rupture) will be more than acceptable as a cook-off resistant booster explosive.

The standard Navy booster explosives tetryl and CH-6 were subjected to the cook-off test above. CH-6 repeatedly cooked-off with a partial detonation (reaction level 4) at an average temperature of 209° C., and tetryl repeatedly cooked-off with a high order detonation (reaction level 5) at an average temperature of 172° C.

In a limited number of tests, an explosive composition (designated PBXW-7) composed of 60 weight percent of TATB, 35 weight percent of RDX (class E), and 5 weight percent of PTFE was subjected to the same type of cook-off test, but with a greater degree of confinement. In this so-called total confinement fast cook-off test, the cookoff bombs were fashioned with solid end caps without any thermocouples penetrating them. Only the severity of reaction data was acquired. In this total confinement cook-off test the lowest level of reaction that can be expected would be a mild pressure rupture (reaction level 2). Tests conducted on PBXW-7 resulted in a mild pressure rupture (level 2).

Obviously numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. An explosive composition having a mild cook-off character comprising:

A. a mixture of explosives comprising (1) from 58 to 62 weight percent of 1,3,5-triamino-2,4,6-trinitrobenzene, and (2) the remainder being a second explosive selected from the group consisting of cyclotetramethylenetetranitramine, cyclotrimethylenetrinitramine, and mixtures thereof; and B. a compatible binder of polytetrafluoroethylene having a glass transiton temperature (Tg) greater than 105° C.

2. The explosive composition of claim 1 wherein the second explosive is cyclotetramethylenetetranitramine.

3. The explosive composition of claim 1 wherein the second explosive is cyclotrimethylenetrinitramine.

4. The explosive composition of claim 1 wherein the weight percent of polytetrafluoroethylene is from 4 to 6 based on the total weight of the explosive mixture.

* * * * *